US012232623B1

(12) United States Patent
Yang

(10) Patent No.: US 12,232,623 B1
(45) Date of Patent: Feb. 25, 2025

(54) SYSTEMS AND METHODS FOR MODULAR SEATING HAVING UNIVERSAL SLOTS

(71) Applicant: James Yang, Yorba Linda, CA (US)

(72) Inventor: James Yang, Yorba Linda, CA (US)

( * ) Notice: Subject to any disclaimer, the term of this patent is extended or adjusted under 35 U.S.C. 154(b) by 0 days.

(21) Appl. No.: 18/812,774

(22) Filed: Aug. 22, 2024

Related U.S. Application Data

(60) Provisional application No. 63/534,053, filed on Aug. 22, 2023.

(51) Int. Cl.

| | |
|---|---|
| ***A47C 13/00*** | (2006.01) |
| ***A47C 4/02*** | (2006.01) |
| ***A47C 4/03*** | (2006.01) |
| ***A47C 7/02*** | (2006.01) |
| ***A47C 7/42*** | (2006.01) |
| ***A47C 7/54*** | (2006.01) |
| ***A47C 7/68*** | (2006.01) |

(52) U.S. Cl.
CPC ..... *A47C 13/005* (2013.01); *A47C 4/02* (2013.01); *A47C 4/021* (2013.01); *A47C 4/028* (2013.01); *A47C 4/03* (2013.01); *A47C 7/02* (2013.01); *A47C 7/021* (2013.01); *A47C 7/42* (2013.01); *A47C 7/546* (2013.01); *A47C 7/705* (2018.08)

(58) Field of Classification Search
CPC ..... A47C 13/005; A47C 4/02; A47C 4/021; A47C 4/028; A47C 4/03; A47C 7/02; A47C 7/021; A47C 7/42; A47C 7/546; A47C 7/705
USPC ..... 297/135, 232, 354.1, 411.2, 248, 249, 297/411.45, 411.46, 452.63, 452.52, 297/440.1, 440.14–440.16
See application file for complete search history.

(56) References Cited

U.S. PATENT DOCUMENTS

| | | | | |
|---|---|---|---|---|
| 2,466,204 | A * | 4/1949 | Brown | A47C 17/045 297/440.16 |
| 2,925,851 | A * | 2/1960 | Weiss | A47C 13/00 297/119 |
| 3,241,885 | A * | 3/1966 | Deaton | F16B 12/20 297/118 |
| D237,328 | S * | 10/1975 | Vogt | D6/336 |
| 5,335,962 | A * | 8/1994 | Gera | A47C 17/02 297/135 |
| D426,393 | S * | 6/2000 | Saad Rionda | D6/361 |
| 8,205,561 | B1 * | 6/2012 | Bierworth | A61G 5/1094 108/157.11 |
| 8,393,685 | B2 * | 3/2013 | Hill | E04H 13/003 297/440.13 |
| 8,764,114 | B1 * | 7/2014 | Frank | A47C 7/42 297/440.16 |

(Continued)

*Primary Examiner* — Robert Canfield
(74) *Attorney, Agent, or Firm* — CIONCA IP Law P.C.

(57) ABSTRACT

Provided herein are modular seating systems for assembling a customizable seating configuration, having: a plurality of frame components, each having: a frame body having legs; a top end having; a groove along each one of the four sides; a corner block at each one of the four corners; a plurality of attachment components, each having: an attachment body; an insert part configured to fit into a groove of the frame components; wherein each attachment component of the plurality of attachment components is configured to associate with any one of the frame components of the plurality of frame components by inserting the insert part of an attachment component into the groove of one of the four sides of the frame body of a frame component.

20 Claims, 23 Drawing Sheets

(56) References Cited

U.S. PATENT DOCUMENTS

| | | | | |
|---|---|---|---|---|
| 8,950,817 | B2 * | 2/2015 | Iacovoni | A47B 13/021 297/135 |
| 10,874,222 | B2 * | 12/2020 | Adams | A47C 1/14 |
| 10,952,536 | B1 * | 3/2021 | Williams | A47B 83/02 |
| D958,555 | S * | 7/2022 | Xiao | D6/361 |
| 11,633,046 | B2 * | 4/2023 | Altemimei | A47C 13/005 297/248 |
| 11,737,572 | B1 * | 8/2023 | Zhang | A47C 4/028 297/233 |
| 2005/0217022 | A1 * | 10/2005 | Oldham | A47C 7/546 5/52 |
| 2012/0248834 | A1 * | 10/2012 | Whidden | A47C 13/005 297/411.27 |
| 2013/0283587 | A1 * | 10/2013 | Mehringer | A47B 87/007 403/20 |
| 2023/0270252 | A1 * | 8/2023 | Shih | A47C 17/02 297/440.11 |
| 2023/0270258 | A1 * | 8/2023 | Shih | A47C 4/028 297/440.11 |
| 2024/0065446 | A1 * | 2/2024 | Parsa | F16B 12/54 |
| 2024/0108145 | A1 * | 4/2024 | Armond | A47C 13/005 |

* cited by examiner

SYSTEMS AND METHODS FOR MODULAR SEATING HAVING UNIVERSAL SLOTS

CROSS-REFERENCE TO RELATED APPLICATIONS

This application claims the benefit of U.S. Provisional Application No. 63/534,053, filed Aug. 22, 2023, which is hereby incorporated by reference, to the extent that it is not conflicting with the present application.

BACKGROUND OF INVENTION

1. Field of the Invention

The invention relates generally to furniture, and more particularly to customizable, modular furniture.

2. Description of the Related Art

Generally, when building a sectional seating system, users require a specific set of components, such as a left side component, a right side component, a corner component, and a middle component. In order to add other items such as a table in between seatings, other components such as a wedge table, and a side table are needed. A multi-functional seating system may therefore require a large number of parts, and could involve over 10 SKUs in order to identify each unique component. This can make the process of creating a customized seating system difficult and expensive for a consumer, and it can be difficult to assemble, and change the configuration after assembly. Some known systems for seating can be movable once assembled, but not easily changed in configuration. Some systems may require that a user have additional help or additional equipment to hold the seat frame if the seating system is to be changed in configuration.

Therefore, there is a need for a solution to the above problems.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

Provided herein are multi-functional, modular seating systems, comprising components having grooves. In some embodiments, the groove is permanently included with a frame as part of the components of the modular seating system. In such embodiments, the construction is very strong and cannot be removed from the component unless the seating frame itself is destroyed. In such embodiments, the groove may be strong enough to hold any parts that are inserted into the groove.

In some embodiments, the components of the seating systems may have grooves along four sides. In such embodiments each groove can hold any other component of the system having an insertable part. An advantage may be that this gives a user the ability to create many different functional seating and table systems according to their needs or preferences.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1A:
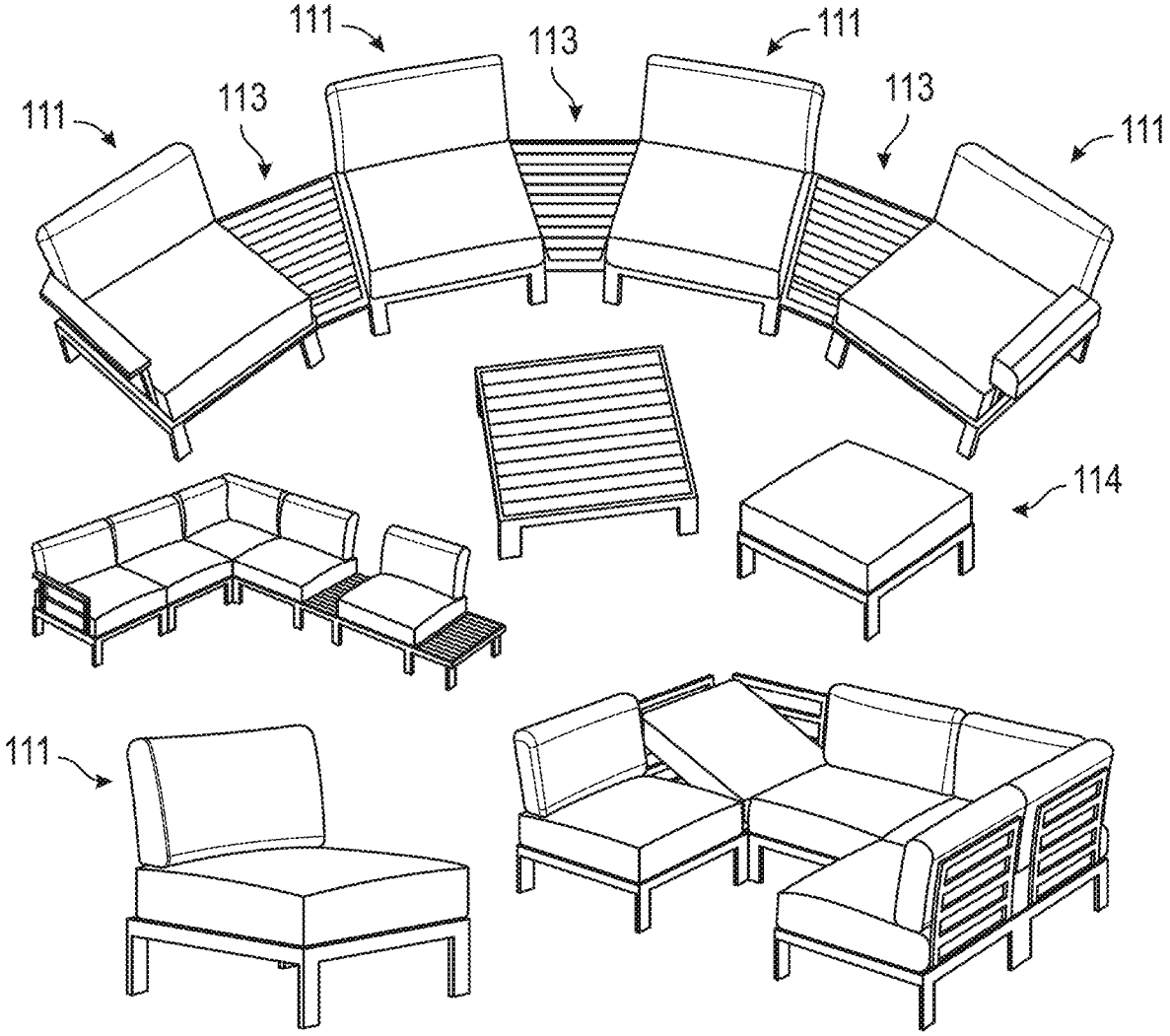
FIG. 1A depicts a variety of exemplary components of a modular seating system, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 105 and 205, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1A depicts a variety of exemplary components of a modular seating system (also referred to herein as a "seating system"), according to an aspect. The modular seating systems disclosed herein may be used for assembling a customizable seating configuration (also referred to generally as a "seating system"), which may include one or more chairs 111. The customizability of the modular system may allow for the arrangement of the chairs in various ways. Other exemplary components depicted in FIG. 1A include rectangular tables, wedge tables 113, and a footrest 114.

Figure 1B:
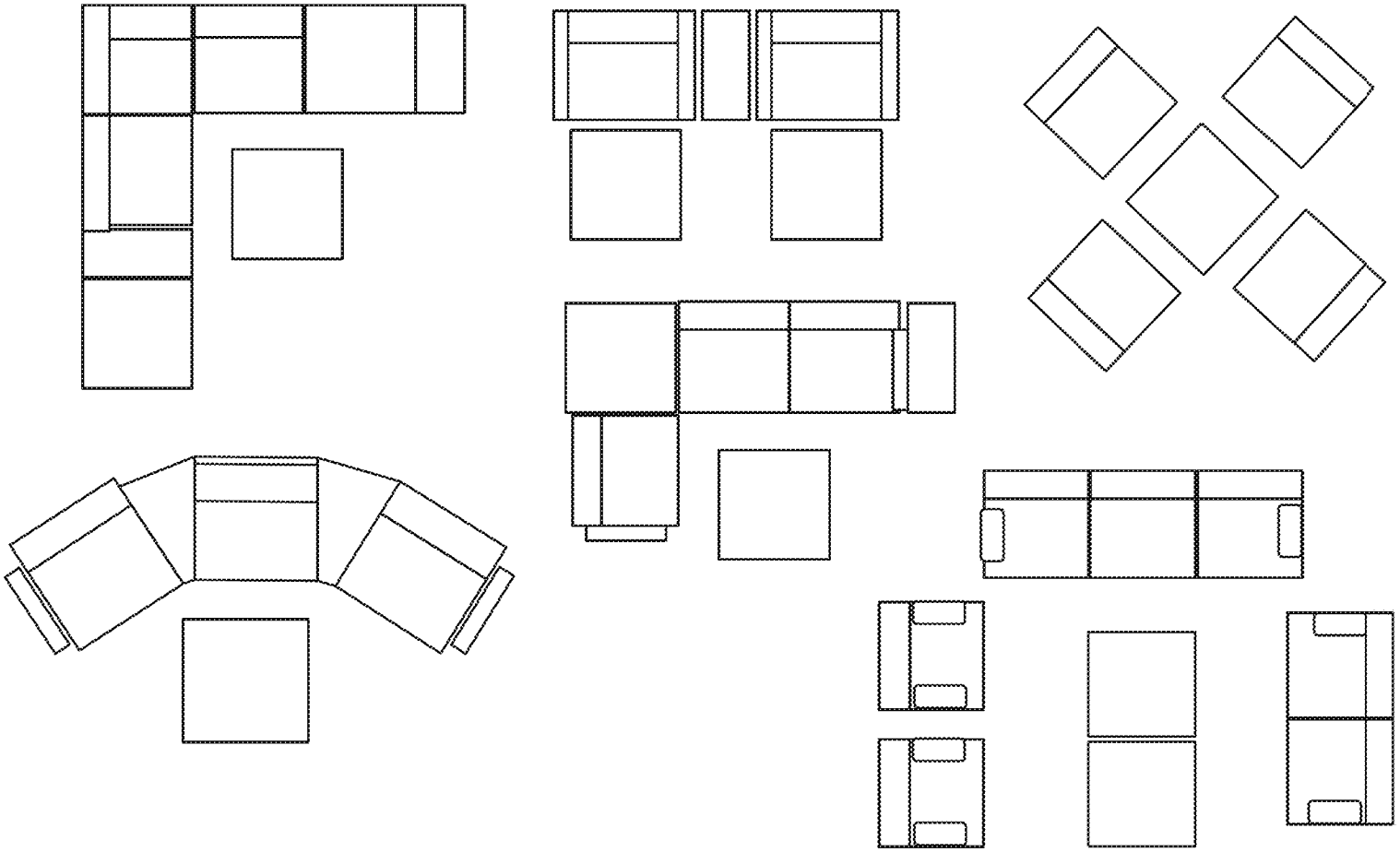
FIG. 1B depicts various exemplary arrangements that can be created using the modular seating systems disclosed herein, according to an aspect.

FIG. 1B depicts various exemplary arrangements that can be created using the modular seating systems disclosed herein, according to an aspect. As examples, the components represented in FIG. 1B include chairs without armrests, chairs having armrests, chairs having a corner back, side tables, wedge table, footrests, side tables, and so on.

FIGS. 2A-2E depicts various views of a seating frame 220, according to an aspect. Provided herein are seating systems wherein the components of the system include components having grooves, and components having insert parts. Such components having grooves generally are seating frames. These seating frames 220 may generally be rectangular, and four-sided, as can be seen in the top plan view of the seating frame depicted in FIG. 2D. Generally the seating frames include a groove 221 along each one of the four sides. The groove of the seating frame can be used for insertion of a variety of components. Such components can include an armrest, a headrest, a rectangular table, a wedge table, and a seat back. Accordingly, the seating systems disclosed herein may include a plurality of components having insert parts, any one of which may be inserted into any one of the grooves of the system. Generally, as used herein, components having grooves may be referred to as "frame components," and components having insert parts may be referred to as "attachment components." In other words, the frame components may be any suitable component having a groove, and any suitable attachment component may attach to the frame components by inserting an insert part into the groove.

Figure 2C:
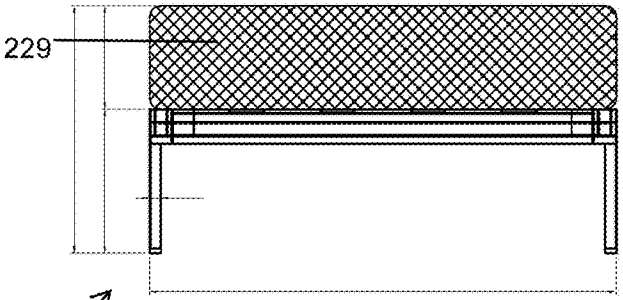
FIGS. 2A-2E depicts various views of a seating frame, according to an aspect.
Figure 2B:
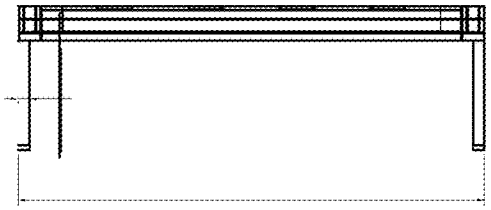
Figure 2A:
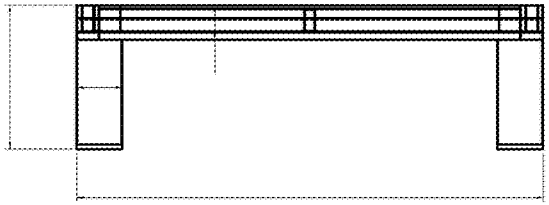
Figure 2E:
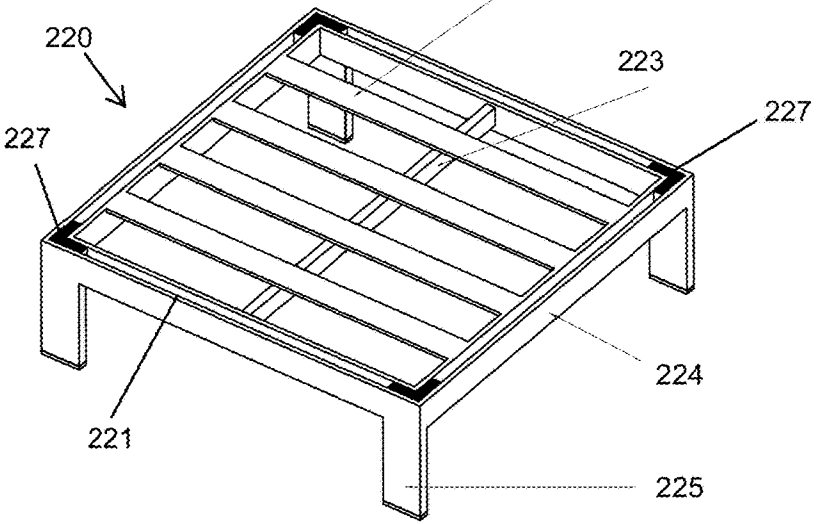
Figure 2D:
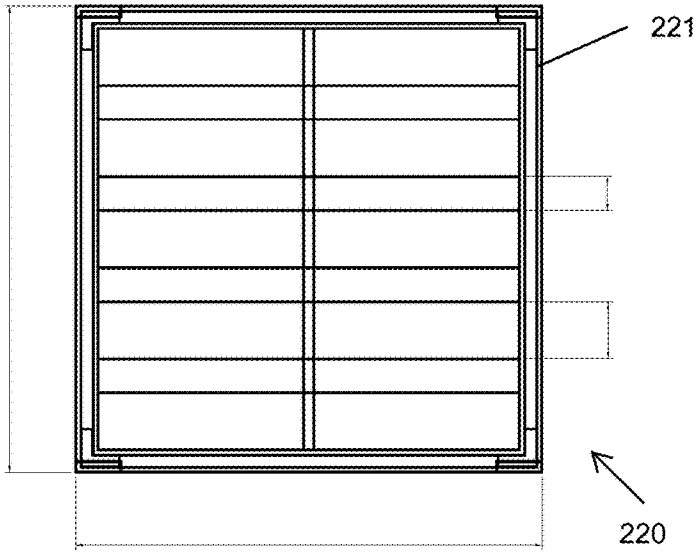

In some embodiments, the components of the modular systems disclosed herein are provided with upholstery or cushioning materials. FIG. 2C depicts a seating frame 220 shown with an exemplary foam cushion 229.

In some embodiments, the seating frames may make up part of chairs, or other components. In some embodiments, the insert parts may be pieces that are added onto the chairs, such as armrests, headrests, and so on. The seating frames 220 may include a central support rod 223, and a plurality of slats 222 which can support the weight of cushions, and a seated user, and so on. The seating frames may also comprise a frame body 224, and legs 225 extending downwards from the top end of the frame body.

The groove of the seating frame can be constructed from any suitable sturdy, durable material. For example, the groove can be constructed from metal. In some embodiments, the components of the seating system may be constructed such that, when an insert part is inserted into a groove, there is approximately 1-2 mm of space between the groove and the insert on either side laterally, such that there is some flexibility maintained between the components. For example, a seat back having an insert part placed onto a seating frame in this manner can be provided with some flexibility for the seat back to move back as desired by a user.

In some embodiments, corner blocks 227 for placement in the groove is provided which can stop the insert from moving from side to side when the insert is placed in the groove. Another advantage of the corner block is that when it is placed in the groove, it can help to cover the groove in the corner of the component, where it would otherwise be visible. In some embodiments, the corner blocks are permanently affixed in the corners of the grooves.

Generally, the seating frames provided herein may be constructed by first cutting a sheet to the appropriate dimensions, and next stamping the grooves into the cut piece. Next, the cut and stamped piece can be welded with other parts to create the seat foundation and final frame. Generally, the components having insert parts may be constructed by first cutting materials to the appropriate dimensions, and form their shapes. Next, friction plates (discussed in more detail herein when referring to at least FIG. 4) may be glued to the insert part on the component.

Figure 3A:
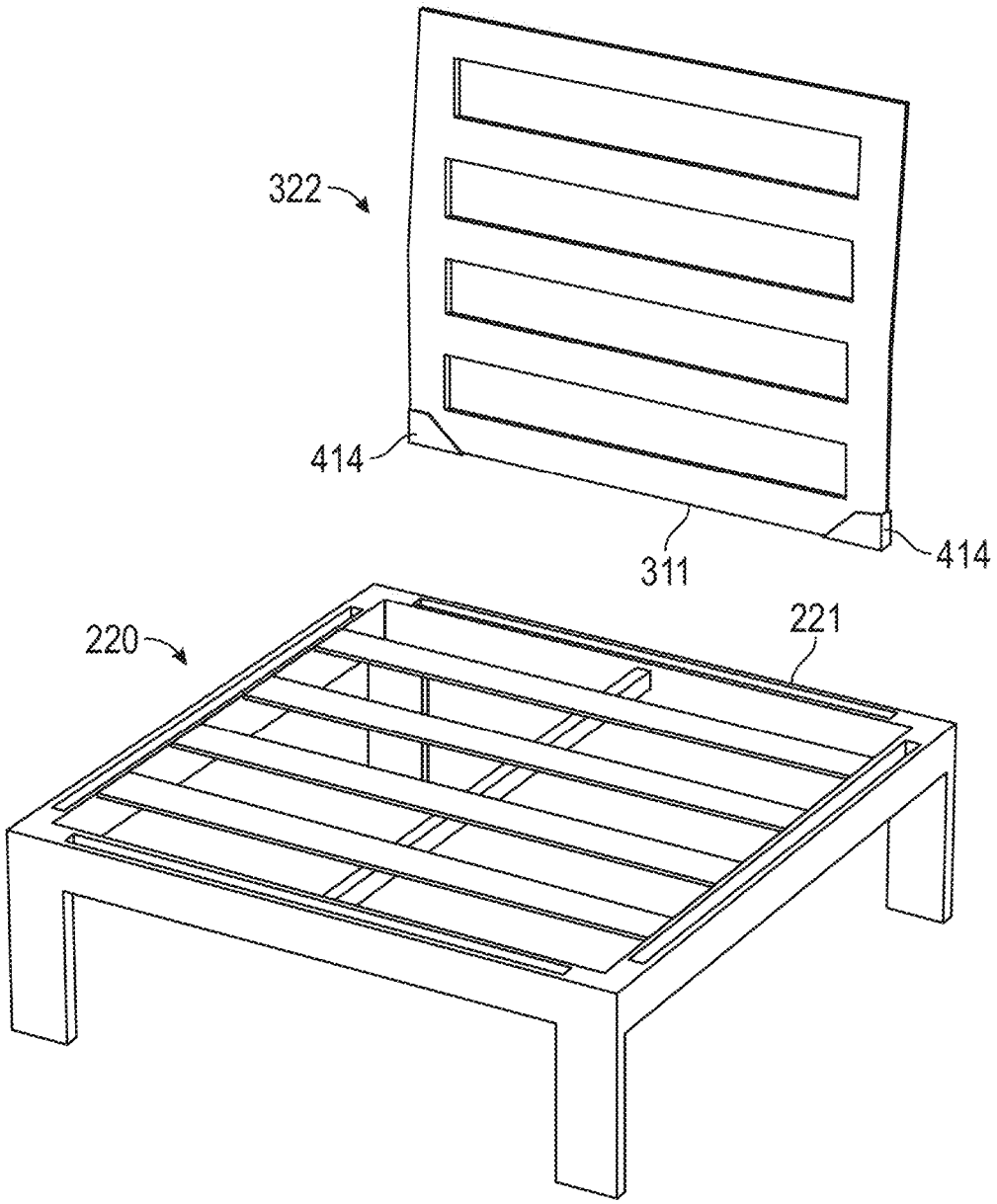
FIGS. 3A-3B depict a seating frame with a seat back attachment component, and with an arm rest attachment component, respectively, according to an aspect.
Figure 3B:
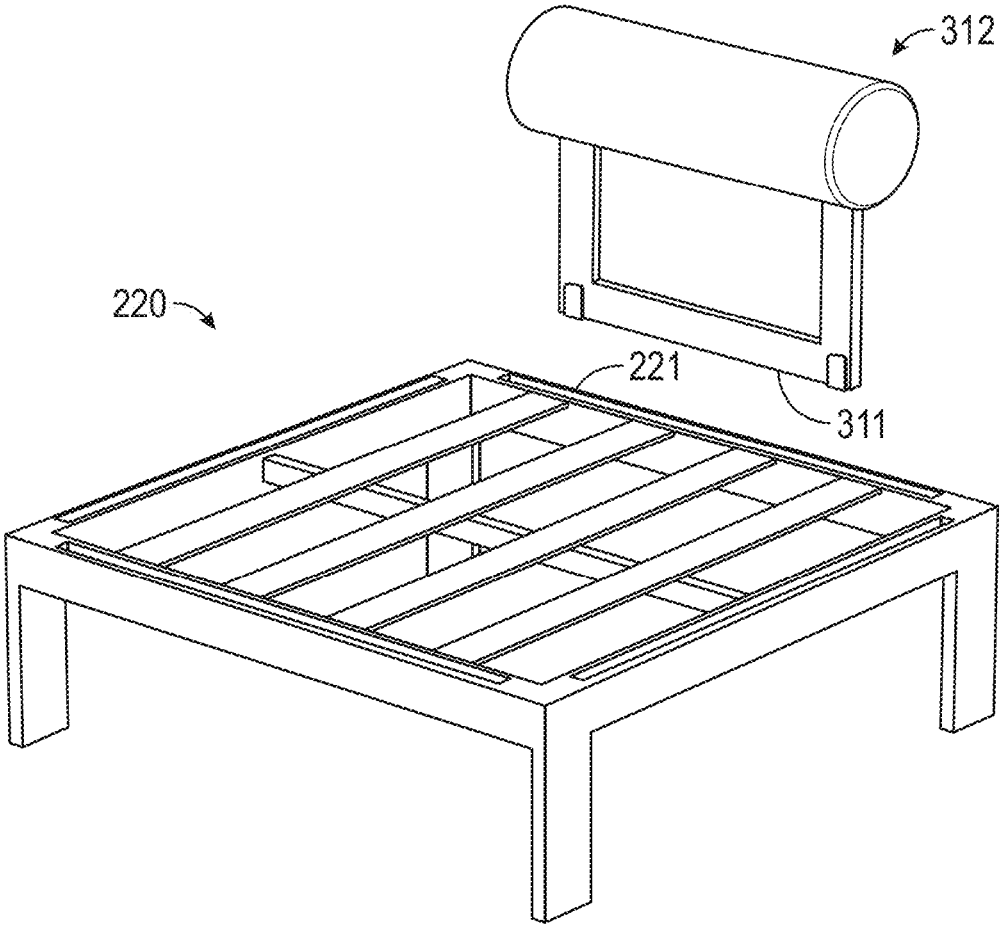

FIGS. 3A-3B depict a seating frame with a seat back attachment component, and with an arm rest attachment component, respectively, according to an aspect. The seating systems disclosed herein may be configured such that any frame component, such as a seating frame 220, having a groove 221 along an upper or top surface can receive any other attachment component having an insert part 311. For example, the seating frame depicted in FIGS. 3A-3B may be the same seating frame. The same seating frame could receive a seat back 322 having an insert part 311, or an arm rest 312 having an insert part 311. Friction plates 414 are also provided on the insert parts, described further herein when referring to at least FIG. 4.

Figure 4:
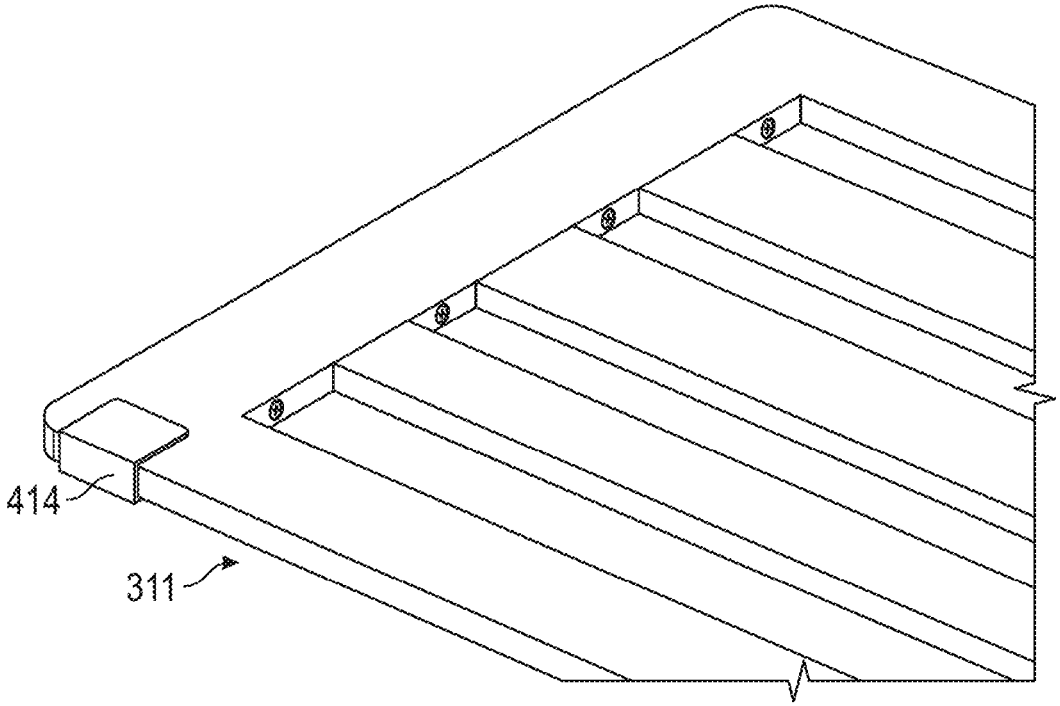
FIG. 4 depicts a detailed enlarged view of a portion of a component having an insert part, according to an aspect.

FIG. 4 depicts a detailed enlarged view of a portion of a component having an insert part 311, according to an aspect. The insert parts 311 of the system may include friction plates 414. The friction plates may be provided to increase friction between the insert part and the groove, and can function to make the insert parts more steady when inserted into the groove. Generally, the friction plates are sufficient to ensure that the attachment components stay securely inserted within the groove of a frame component.

Figure 5D:
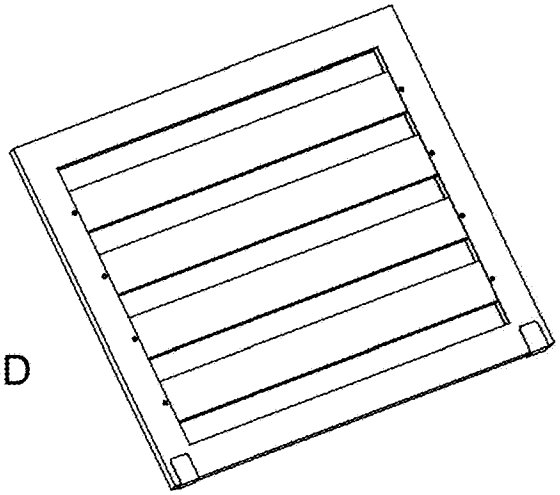
FIGS. 5A-5E depict various views of a seat back attachment component, according to an aspect.
Figure 5E:
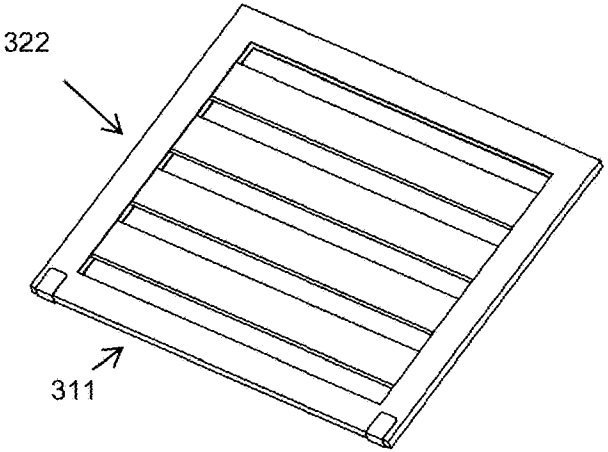
Figure 5C:
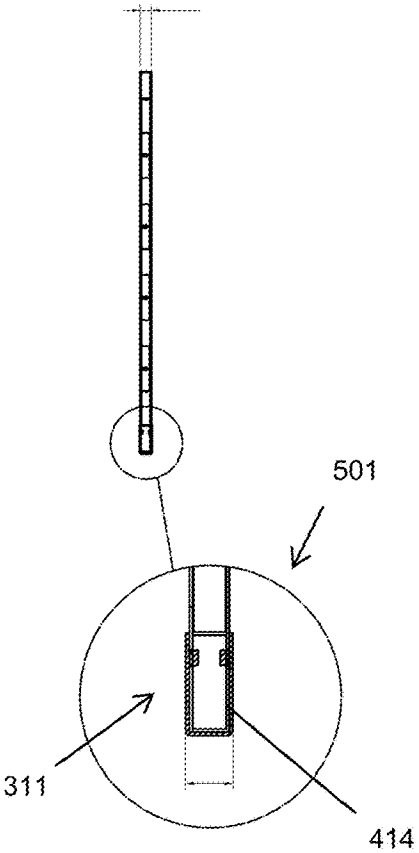
Figure 5A:
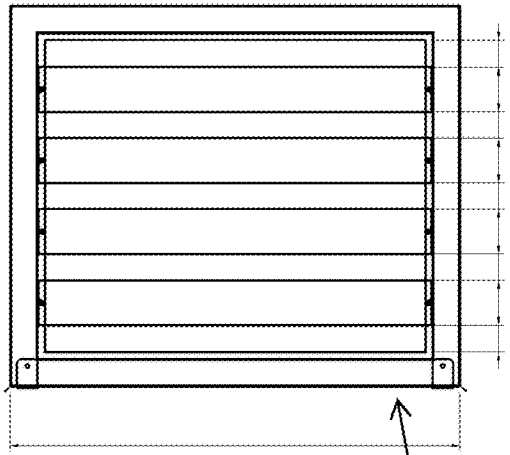
Figure 5B:
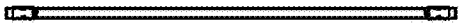
Figure 6C:
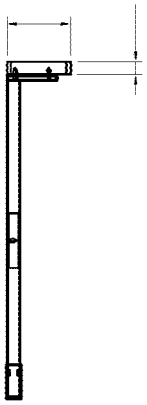
FIGS. 6A-6D depict various views of another example of an arm rest attachment component, according to an aspect.
Figure 6D:
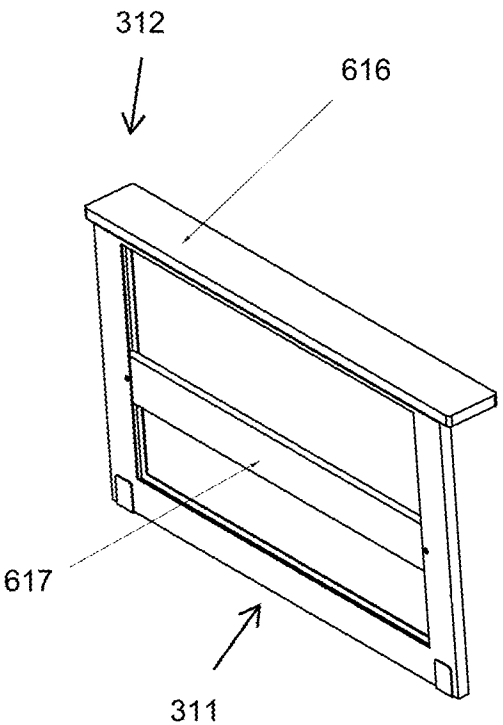
Figure 6A:
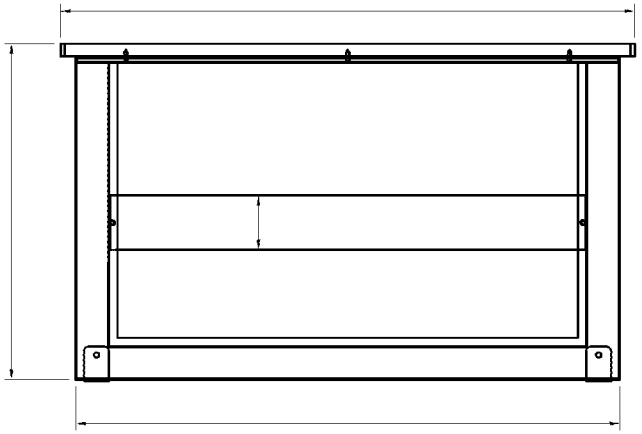
Figure 6B:
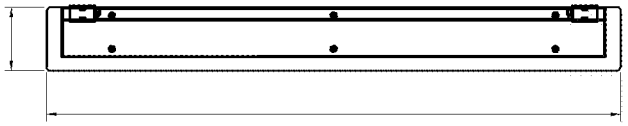
Figure 7C:
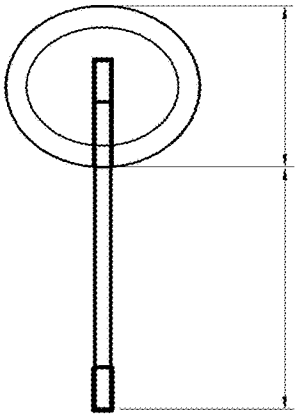
FIGS. 7A-7D depict various view of another example of an arm rest attachment component, according to an aspect.
Figure 7D:
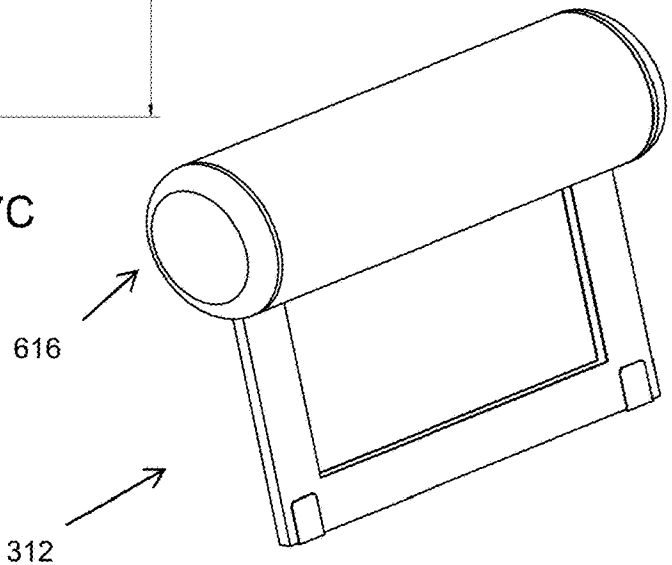
Figure 7A:
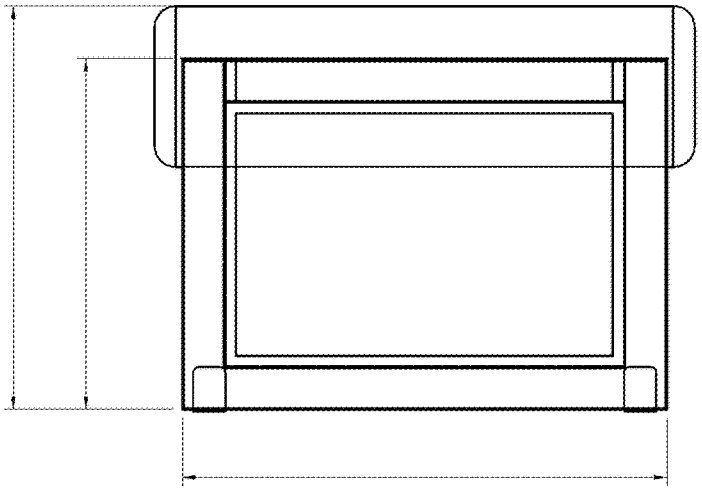
Figure 7B:
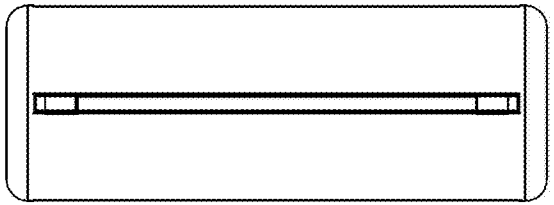

FIGS. 5A-5E depict various views of a seat back attachment component 322, according to an aspect. FIG. 5C depicts a detailed enlargement 501 of a side view of the insert part 311, showing the friction plate 414.

FIGS. 6A-6D depict various views of another example of an arm rest attachment component 312, according to an aspect. In some embodiments, the arm rest attachment component may include a top arm rest piece 616, a center support slat 617, and an insert part 311 at a bottom end of the attachment component. In some embodiments, the arm rest may have a wood or faux wood finish on the top arm rest piece 616.

FIGS. 7A-7D depict various view of another example of an arm rest attachment component 312, according to an aspect. In some embodiments, the arm rest may be upholstered at the top arm rest piece 616. Generally, attachment components such as the exemplary component depicted in FIGS. 7A-7D could be used as head rests, or as arm rests, and could be provided in any suitable shapes or dimensions to fit such needs.

Figure 8C:
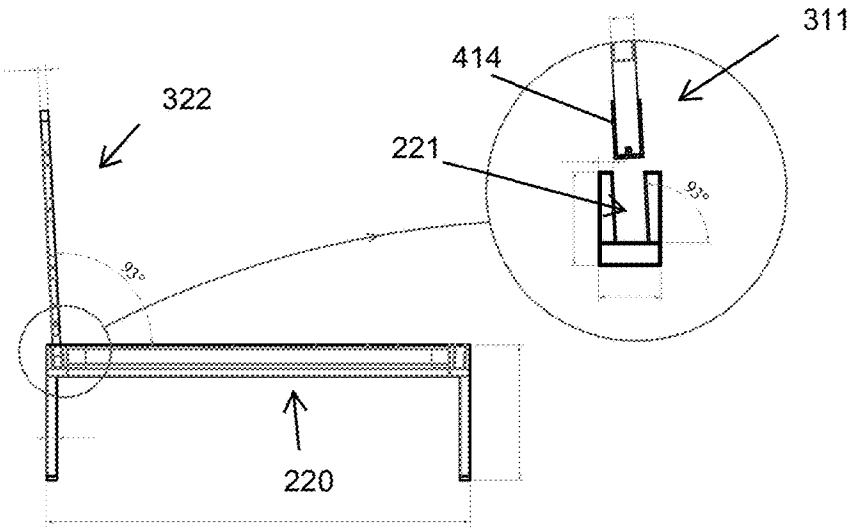
FIGS. 8A-8D depict various views of a seating frame component associated with a seat back attachment component, according to an aspect.
Figure 8A:
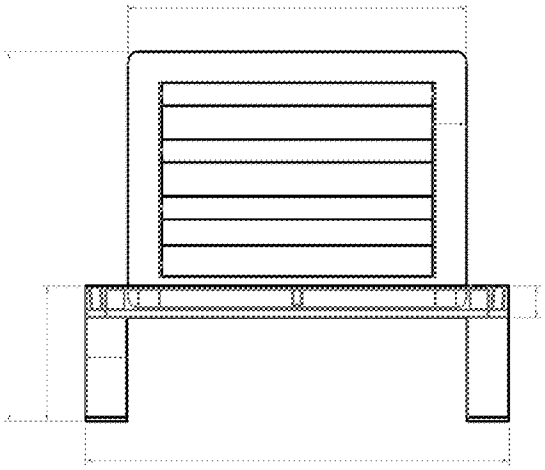
Figure 8B:
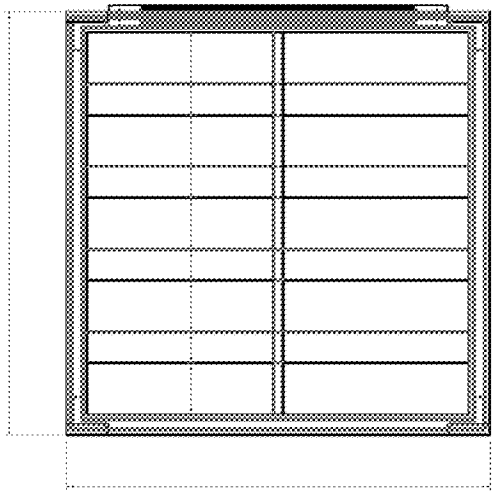

FIGS. 8A-8D depict various views of a seating frame component 220 associated with a seat back attachment component 322, according to an aspect. FIG. 8C includes a detailed enlargement showing the association of the insert part 311 having friction plates 414 into the groove 221 of the seating frame. In some embodiments, certain components are configured with the ability to flex and tilt a certain amount of degrees while the insert part is placed into the groove. An exemplary degree of 93 degrees is provided as an example. A seat back 322 may, for example, be positioned at a 900 angle and be capable of tilting to a 930 angle when a user leans back on the seat back. However, it should understood that the angle of tilt can vary.

Generally, the seat backs disclosed herein may be configured to be able to flex when a user applies some force to the seat back assembled with a seating frame. These components may be constructed from a high quality aluminum, or any other suitable material that can provide a sturdy and durable construction while also providing the ability to flex for added comfort to a user.

Figure 8D:
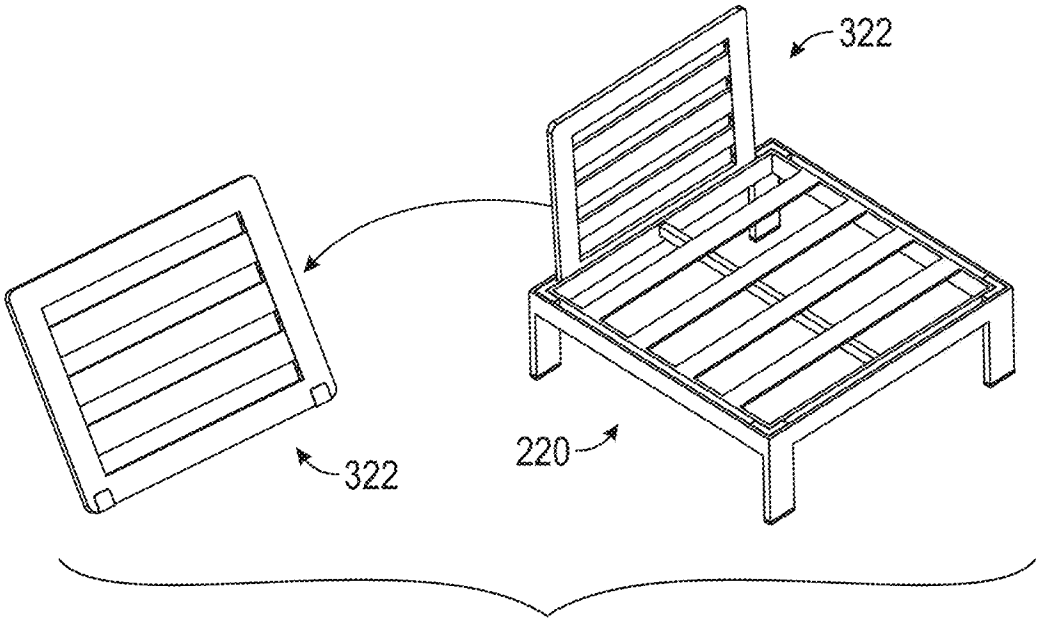

FIG. 8D provides a view of the assembled chair having a seat back 322 and seating frame 220, and shows that the seat back 322 can be easily removed from the seating frame if needed.

Figure 9B:
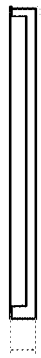
FIGS. 9A-9D depict various views of the seating system components that can be used to arrange a wedge table with chairs, according to an aspect.
Figure 9A:
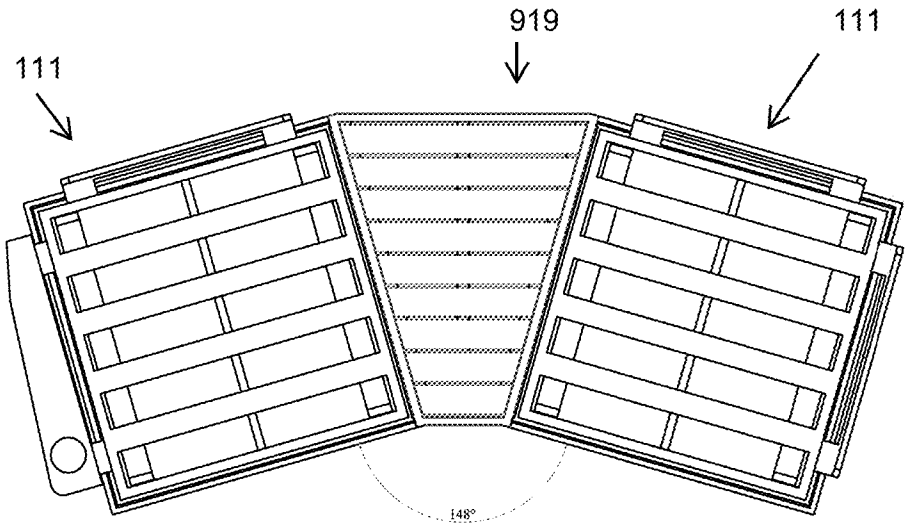
Figure 9C:
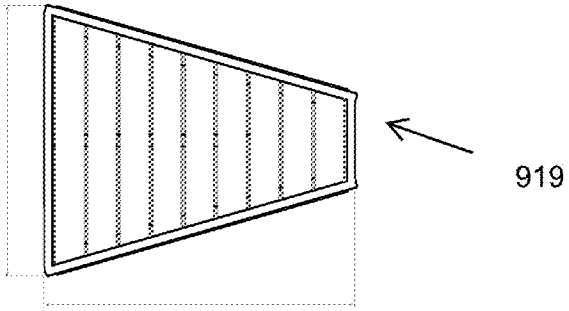
Figure 9D:
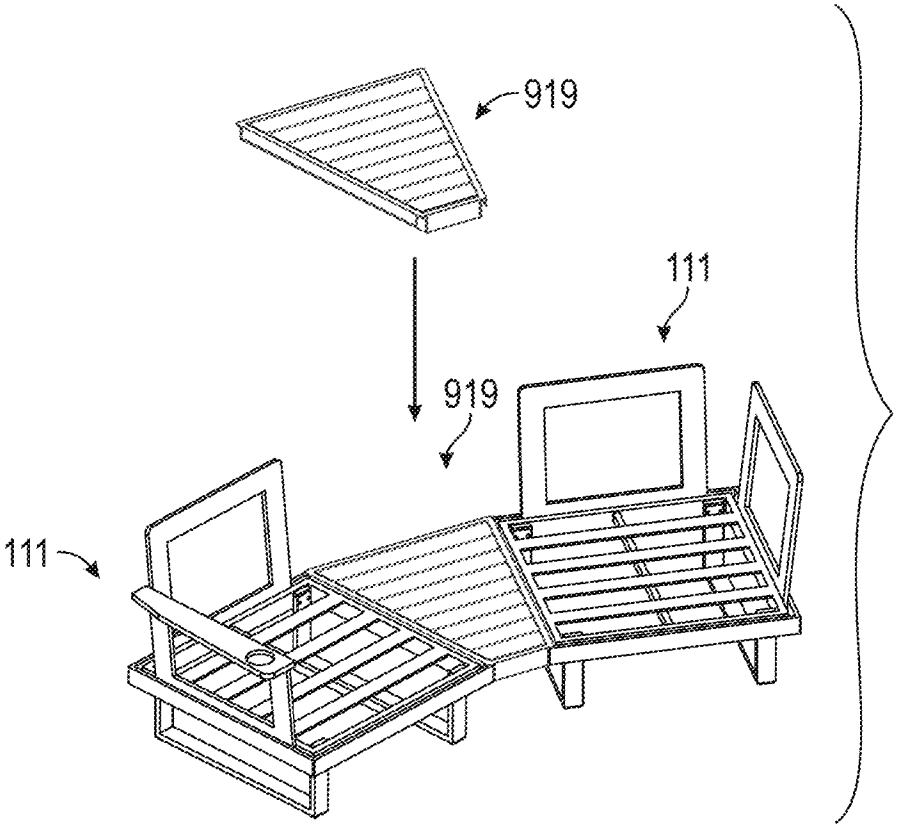
Figure 10B:
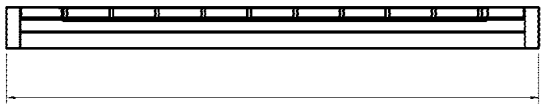
FIGS. 10A-10E depict additional various views of a wedge table that may be used with any of the other components of the seating systems disclosed herein, according to an aspect.
Figure 10C:
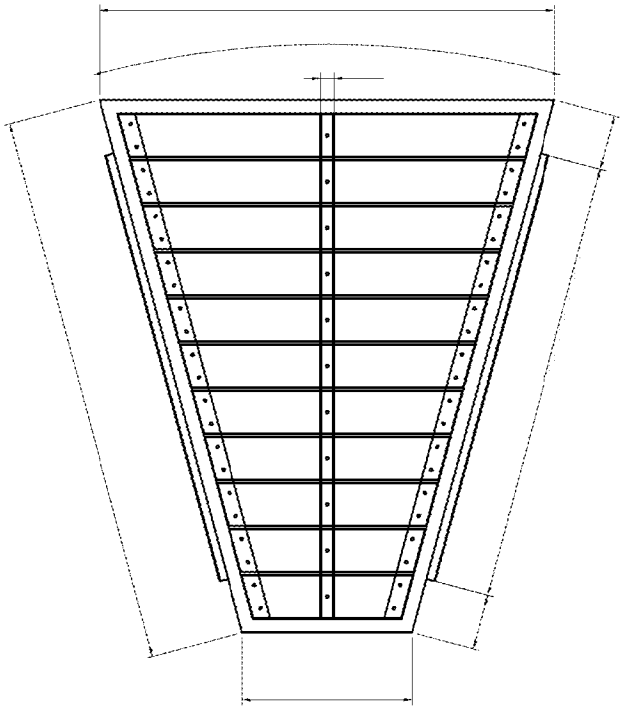
Figure 10A:
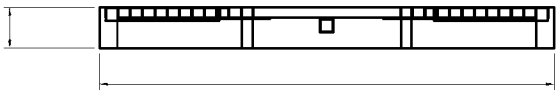
Figure 10E:
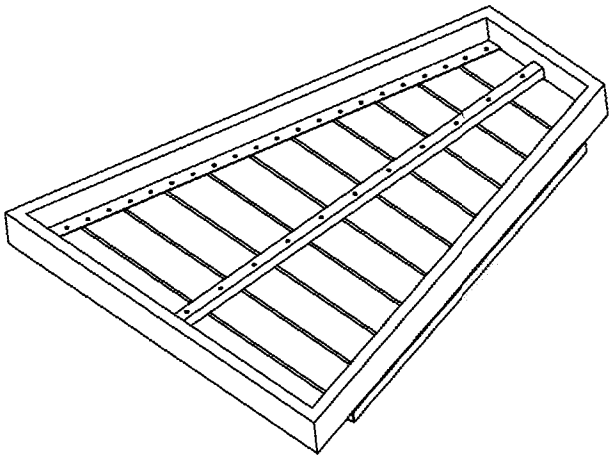
Figure 10D:
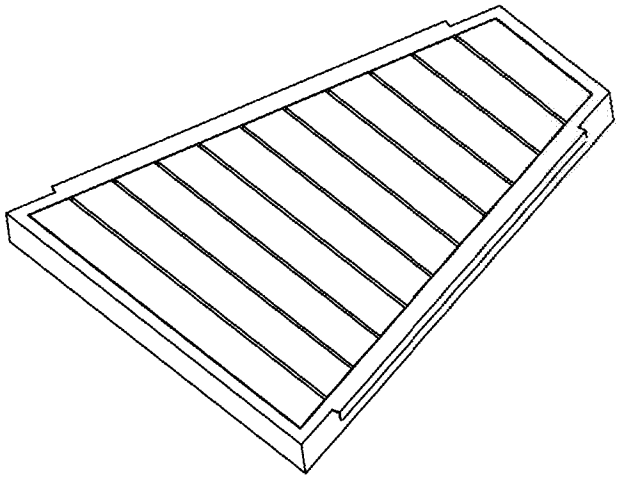

FIGS. 9A-9D depict various views of the seating system components that can be used to arrange a wedge table with chairs, according to an aspect. FIG. 9A shows a top plan view of a wedge table 919 placed between two chairs 111. FIGS. 9B-9C depict a side elevation and a top plan view, respectively, of a wedge table 919. FIG. 9D depicts a side perspective view of the arrangement of the seating system of FIG. 9A. Generally, wedge tables may be provided such that chairs can be placed at an angle with respect to each other. An exemplary angle of 148° is provided. However, it should be understood that other suitable angles could also be achieved by providing wedge tables of various shapes and sizes.

FIGS. 10A-10E depict additional various views of a wedge table that may be used with any of the other components of the seating systems disclosed herein, according to an aspect.

Figure 11B:
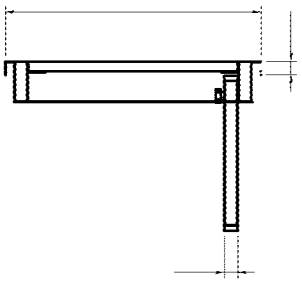
FIGS. 11A-11F depict various views of a rectangular table that may be used with any of the other components of the seating systems disclosed herein, according to an aspect.
Figure 11D:
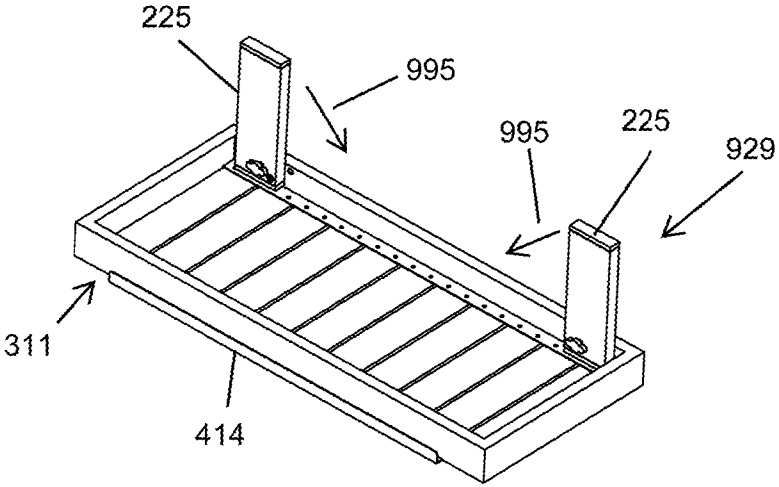
Figure 11A:
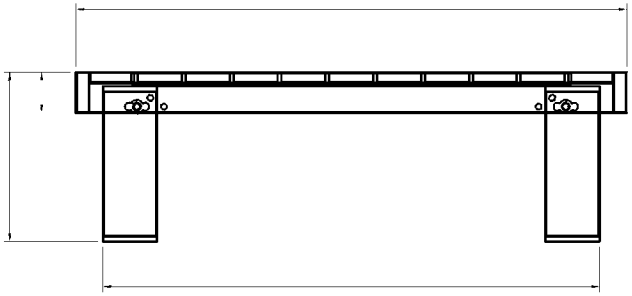
Figure 11C:
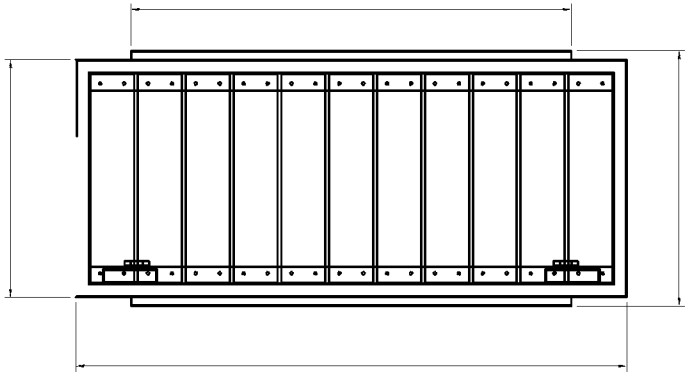
Figure 11E:
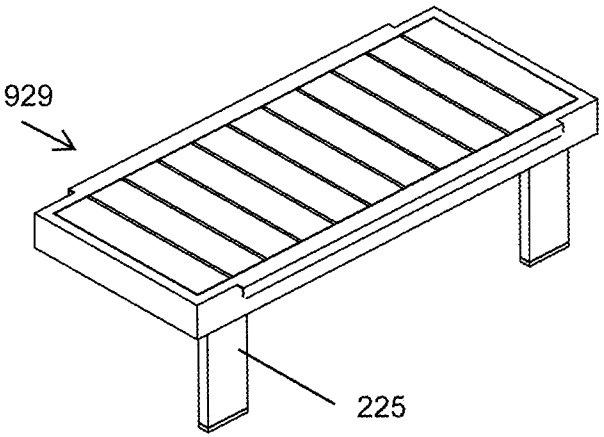
Figure 11F:
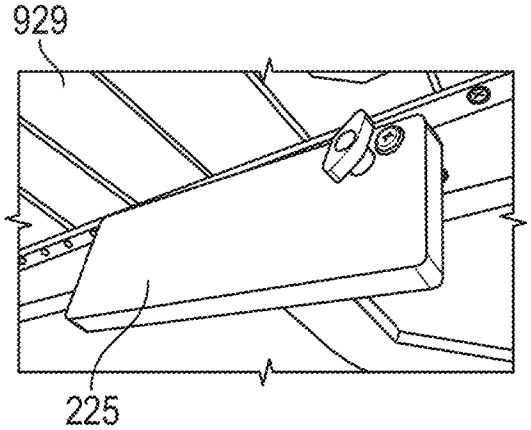

FIGS. 11A-11F depict various views of a rectangular table 929 that may be used with any of the other components of the seating systems disclosed herein, according to an aspect. The rectangular table 929 may be used as an end table (or side table) at the end or any side of a seating system, or a middle table in between two seats, by providing the table with foldable legs. In some embodiments, the rectangular tables 929 disclosed herein may directly attach to another component along one lateral side, and accordingly, the rectangular table may be provided with two legs 225 on each lateral side, wherein each of the legs are foldable such that the table can be used with legs only on one lateral side, or with no legs, if the table is attached in between two chairs, thus removing the need for the legs on the table. In some embodiments, the insert part 311 of certain attachment components such as the exemplary rectangular table 929 shown in FIG. 11D may be provided with a friction plate 414. FIG. 11D also depicts two legs 225 in an unfolded position. The legs may be folded down into the directions indicated by arrows 995 such that the table 929 can be used without legs, for example. FIG. 11F depicts a detailed enlarged view of a leg 225 folded laterally along the underside of a rectangular table 929 such that the rectangular table can be used without at least some of its legs.

Figure 12A:
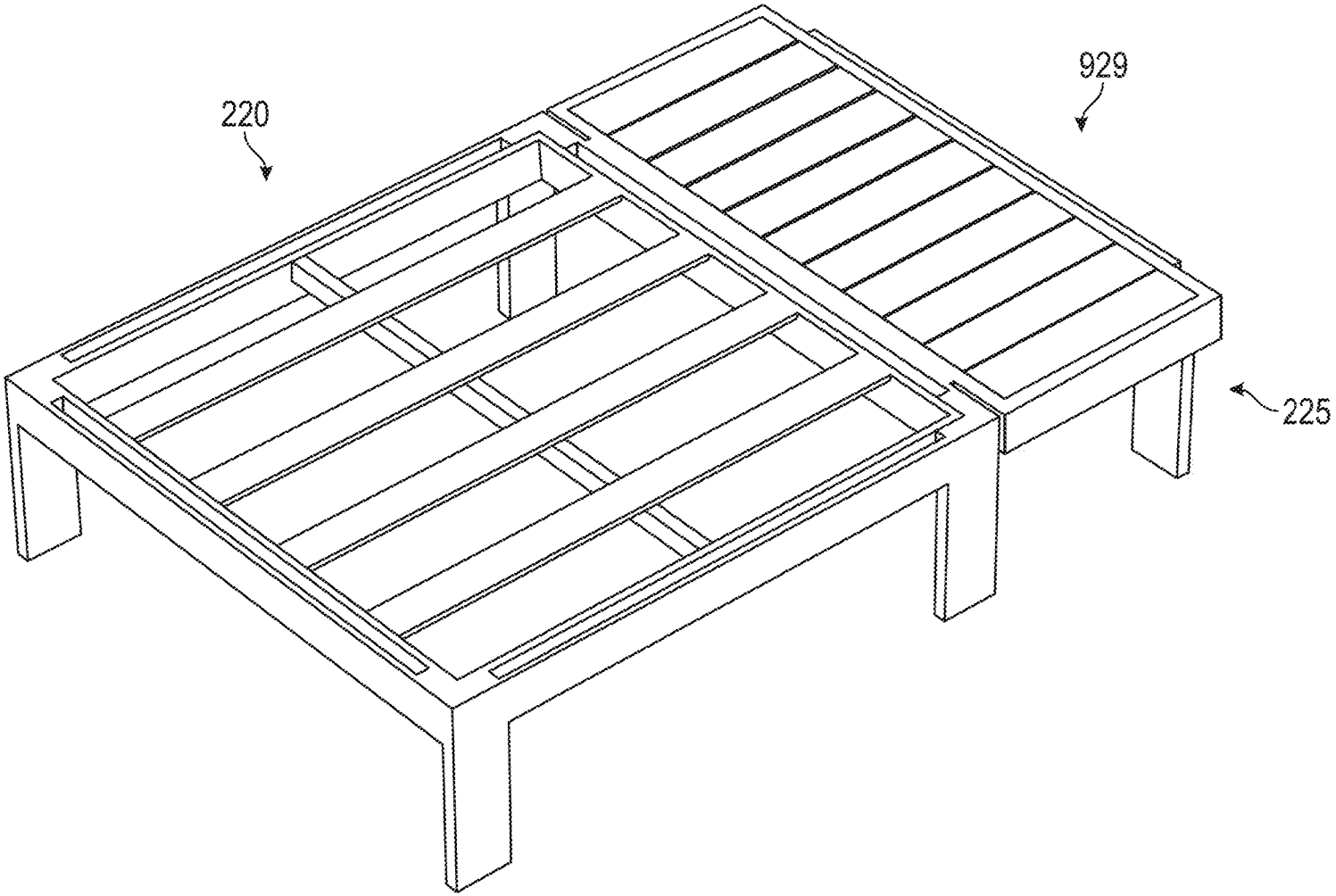
FIGS. 12A-12B depicts a various configurations of the seating system, according to an aspect.
Figure 12B:
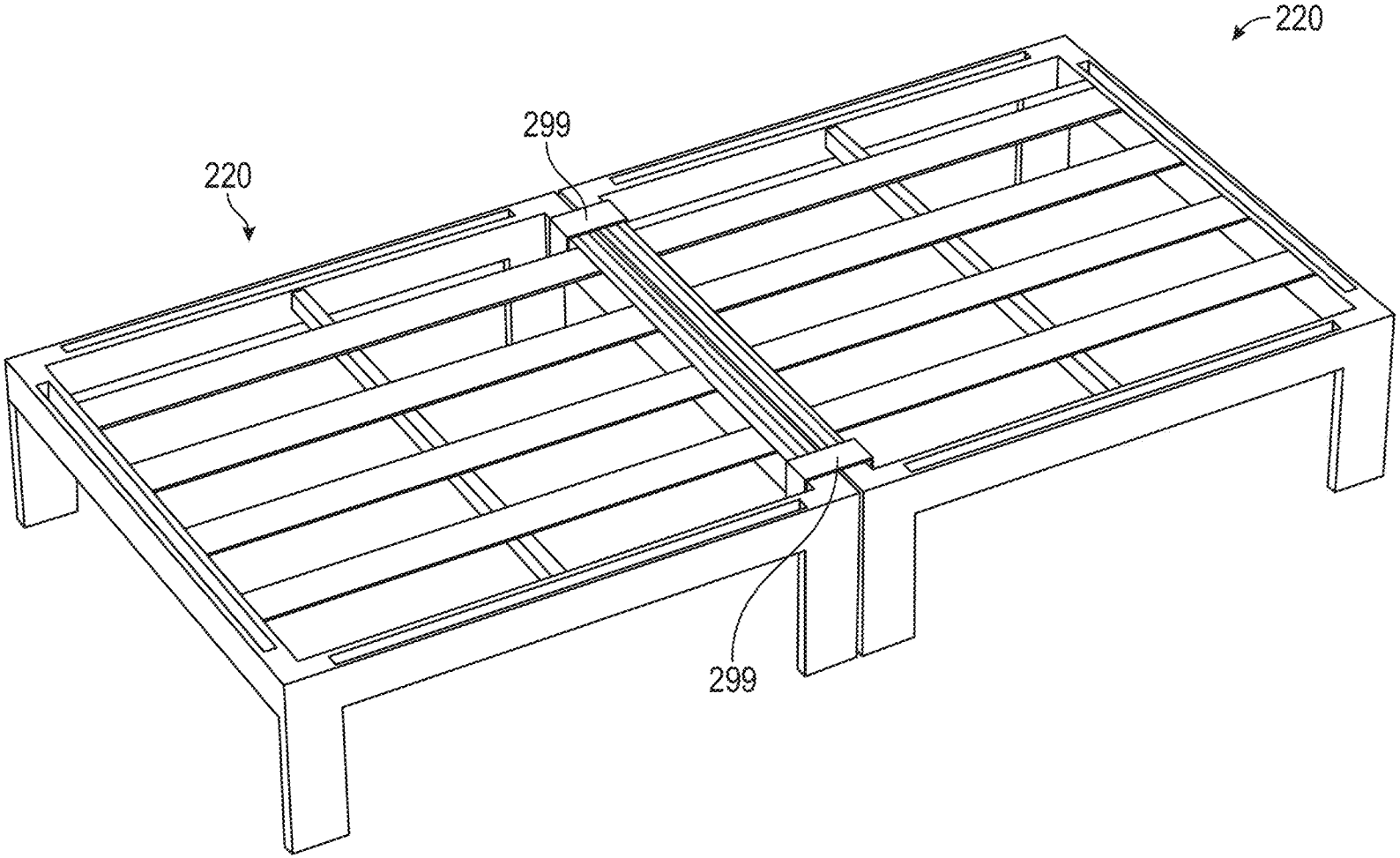
Figure 13A:
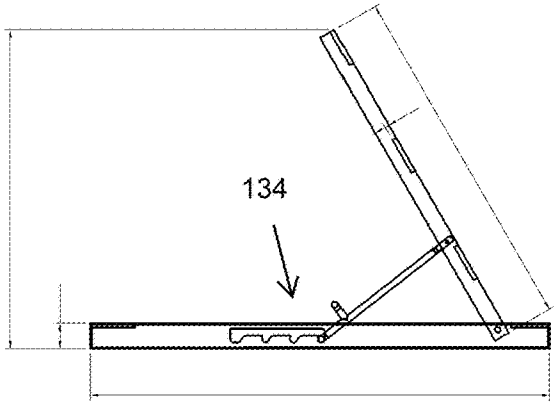
FIGS. 13A-13E depict various views of a lounger attachment component, according to an aspect.
Figure 13B:
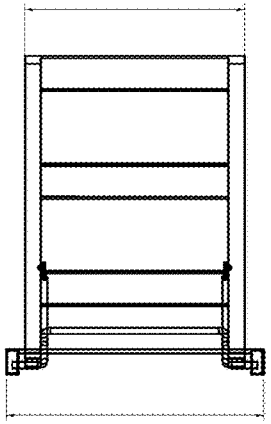
Figure 13C:
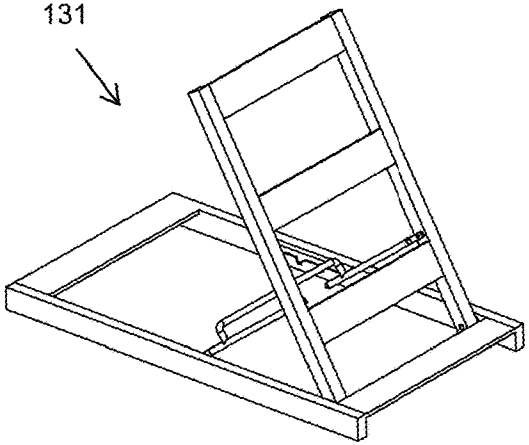
Figure 13D:
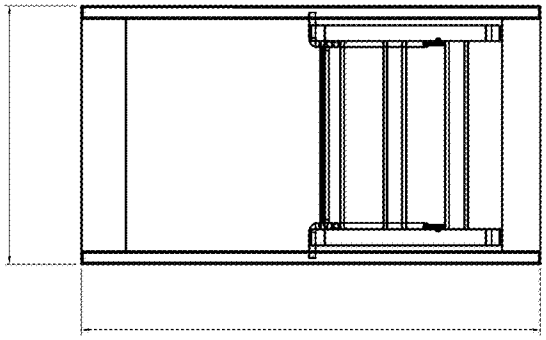
Figure 13E:
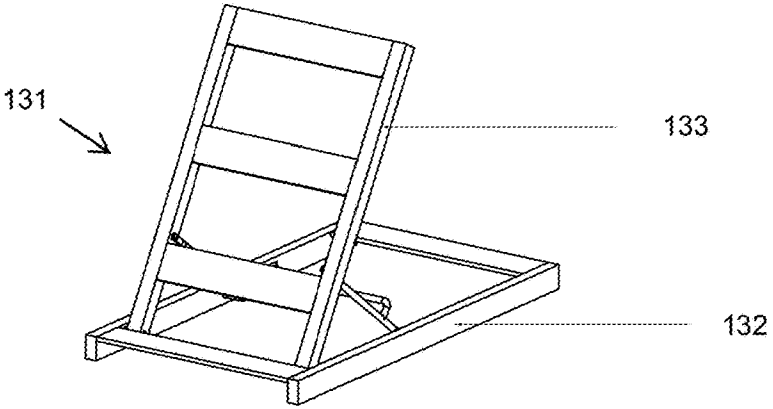

FIGS. 12A-12B depicts a various configurations of the seating system, according to an aspect. FIG. 12A depicts a seating frame 220 attached with a rectangular table attachment component 929. As discussed when referring to FIGS. 11A-11E, a rectangular table may be directly inserted into the groove of a seating frame such that legs 225 are needed only one lateral side of the rectangular table. FIG. 12B depicts two seating frames associated together. Supplemental insert pieces 299 (also referred to herein as "U-shaped connectors") may be used to clip together frame components, acting as attachment components such that additional attachment components having an insert part are not needed if a user wishes to attach two frame components together. The U-shaped connectors may be substantially U-shaped having a first insert part and a second insert part such as that the U-shaped connector can be inserted into a first frame attachment and a second frame attachment, therefore connecting the first and second frame attachments together.

FIGS. 13A-13E depict various views of a lounger attachment component 131, according to an aspect. A lounger attachment component (also referred to herein as "lounger") may be used to attach to a seating frame, and may be configured to adjust. The lounger may comprise a lounger body 132, and a lounger movable piece 133. The adjustability may allow for the lounger movable piece 133 could be adjusted such that it can be placed at a desired angle, or flat against the body 132. The movable piece 133 could be moved by using sliding components, or any other suitable components, for example. The lounger body 132 may be provided with a hook system 134 such that, when the movable piece 133 is placed at a desired angle, the movable piece 133 can be secured at this position. The lounger attachment component could be configured such that it includes two insert parts along opposite lateral sides, therefore being configured to sit on top of a seating frame component by being received into two opposite grooves of the seating frame component (as shown and discussed in further detail when referring to FIG. 14C).

Figure 14A:
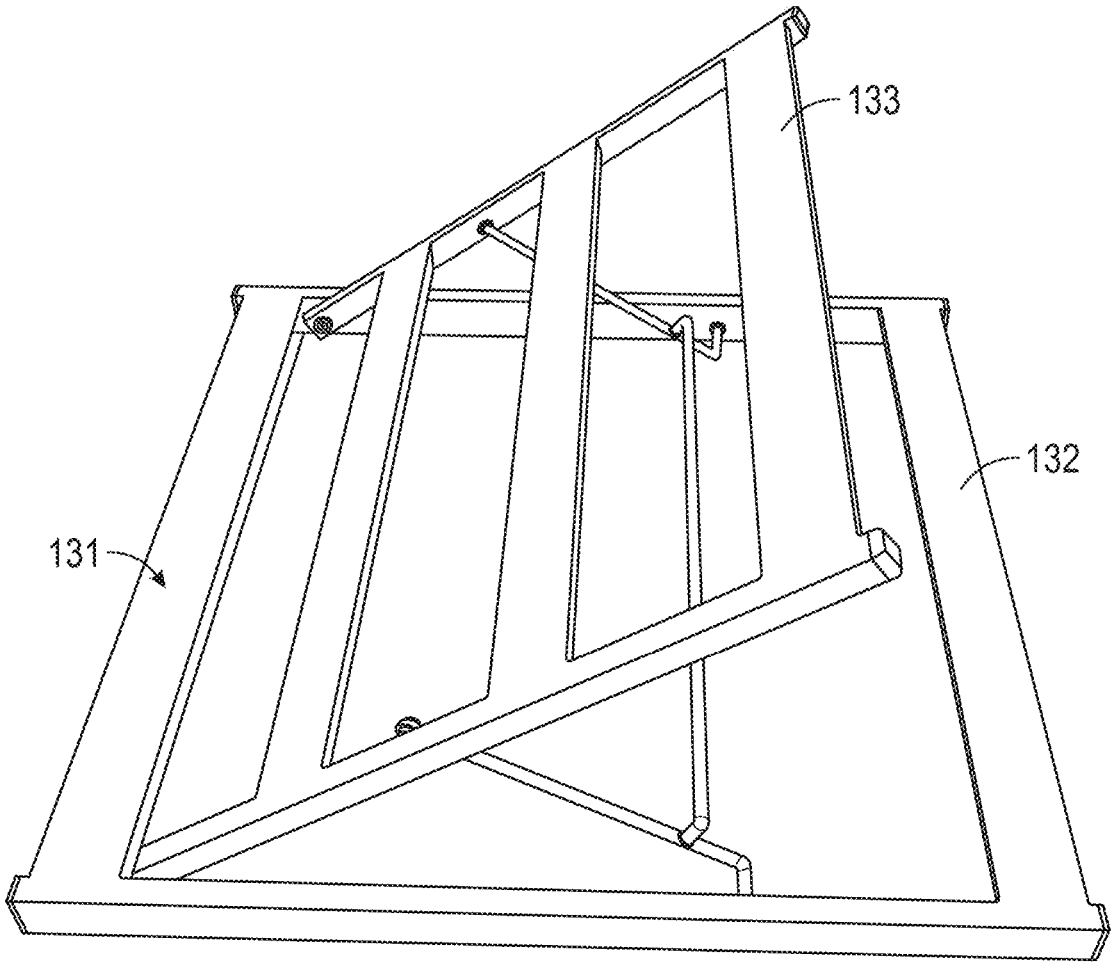
FIGS. 14A-14B depicts a perspective views of a lounger attachment component with the movable piece positioned at an angle, and the movable piece flat against the lounger body, respectively, according to an aspect.
Figure 14B:
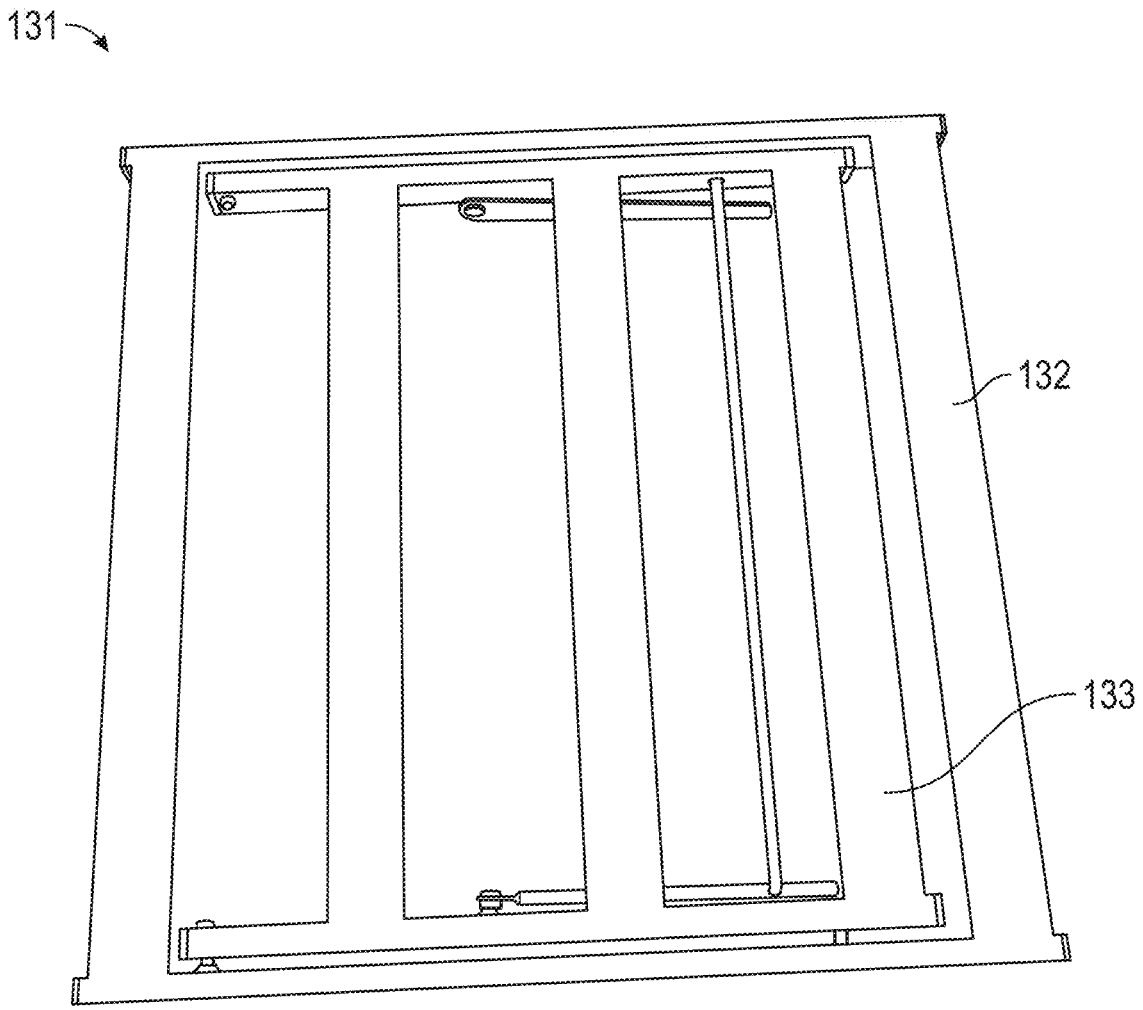

FIGS. 14A-14B depicts a perspective views of a lounger attachment component 131 with the movable piece 133 positioned at an angle, and the movable piece 133 flat against the lounger body 132, respectively, according to an aspect.

Figure 14C:
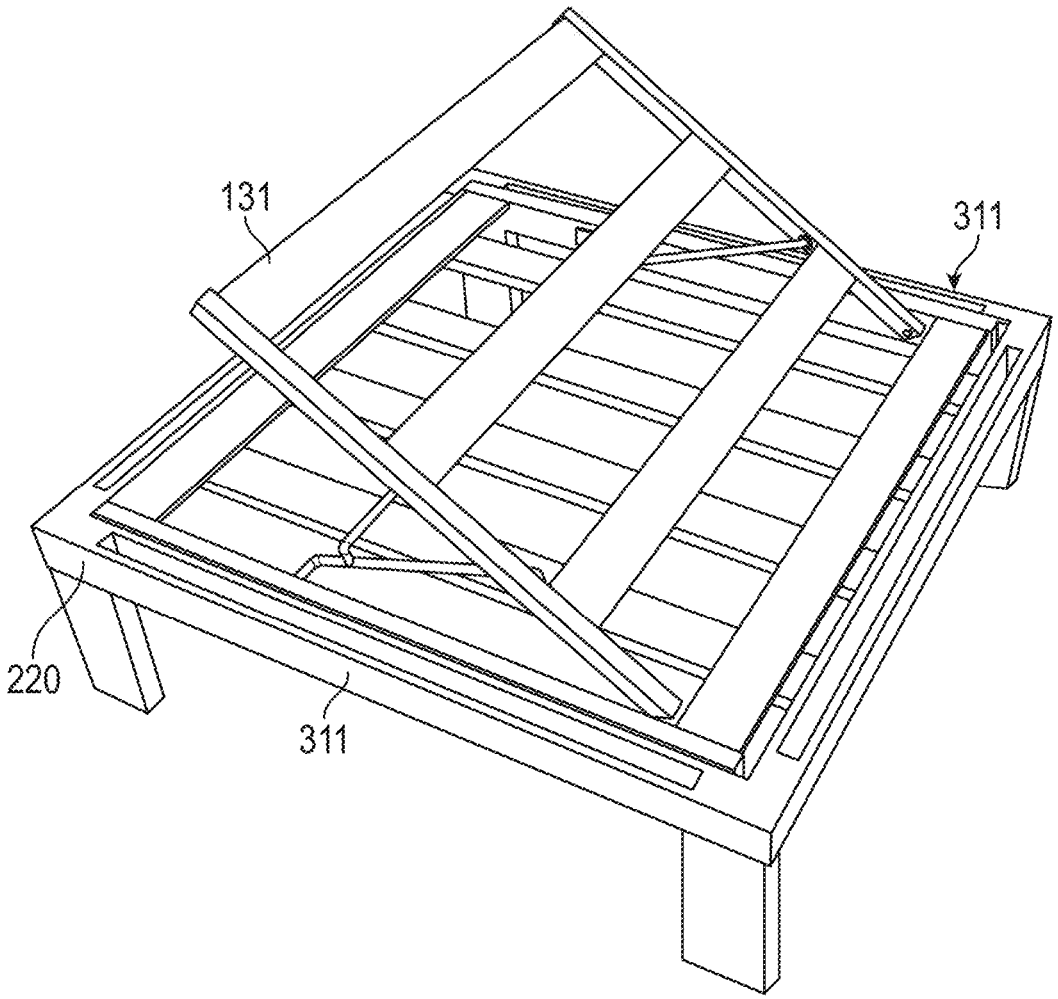
FIG. 14C depicts a top perspective view of a lounger attachment component attached to a seating frame, according to an aspect.

FIG. 14C depicts a top perspective view of a lounger attachment component 131 attached to a seating frame 220, according to an aspect. The lounger 131 is shown with the movable piece positioned at an angle. Again, the lounger can be provided with two insert parts, generally at the regions pointed to by 311, which can be inserted into two grooves opposite to each other on the frame component 220.

It should be understood that each of the components of the seating systems disclosed herein may be upholstered or provided with cushions in order to provide comfortable seating. It should also be understood that components such as the rectangular tables and wedge tables may be provided with any suitable finish, such as a wood finish or a faux wood finish. Generally, the components of the seating system may also be constructed from materials that are water and fade resistant, and UV protected, and anti-mildew such that the seating systems are suitable for outdoor use. The upholstery and cushions could therefore be quick dry materials.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A modular seating system for assembling a customizable seating configuration, comprising:

a plurality of frame components, each frame component comprising:
- a seating frame body having legs;
- a top end having four sides and four corners;
- a groove along each one of the four sides; and
- a corner block at each one of the four corners;
- wherein the groove is constructed from metal;

a plurality of attachment components, each attachment component comprising:
- an attachment body;
- an insert part configured to fit into a groove of the plurality of frame components, the insert part having a first side and a second side; and
- at least one friction plate associated with the insert part;
- wherein the at least one friction plate wraps around the insert part such that the at least one friction plate surrounds a portion of the first side and a portion of the second side of the insert part; and
- wherein the at least friction plate is configured to allow the attachment body to tilt to a predetermined angle within the groove when a force is applied to the attachment body; and a plurality of cushioning materials configured to be associated with the plurality of frame components and the plurality of attachment components;

wherein each attachment component of the plurality of attachment components is configured to associate with any one of the frame components of the plurality of frame components by inserting the insert part of an attachment component into the groove of one of the four sides of the frame body of a frame component.

2. The modular seating system of claim 1, wherein the plurality of frame components comprises seating frames configured to seat a user.

3. The modular seating system of claim 1, wherein the at least one friction plate is configured to increase friction between the insert part and the groove.

4. The modular seating system of claim 1, wherein the plurality of attachment components comprises an arm rest.

5. The modular seating system of claim 1, wherein the plurality of attachment components comprises a chair seat back.

6. The modular seating system of claim 1, wherein the plurality of attachment components comprises a wedge table.

7. The modular seating system of claim 1, wherein the plurality of attachment components comprises a rectangular table.

8. The modular seating system of claim 1, wherein the plurality of attachment components comprises a lounger attachment component having a first insert part along a first lateral side, and a second insert part along a second lateral side opposite to the first lateral side.

9. The modular seating system of claim 1, wherein the plurality of attachment components comprises a supplemental insert piece having a first groove insert configured to fit into a first groove of a first frame component, and a second groove insert configured to fit into a second groove of a second frame component, such that the first frame component and the second frame component are attached together.

10. A modular seating system for assembling a customizable seating configuration, comprising:

a plurality of frame components, each frame component comprising:
- a frame body having legs;
- a top end having four sides and four corners; and
- a groove along each one of the four sides;

a plurality of attachment components, each attachment component comprising:
- an attachment body;
- an insert part configured to fit into a groove of the plurality of frame components, the insert part having a first side and a second side; and
- at least one friction plate associated with the insert part;
- wherein the at least one friction plate wraps around the insert part such that the at least one friction plate surrounds a portion of the first side and a portion of the second side of the insert part;

wherein each attachment component of the plurality of attachment components is configured to associate with any one of the frame components of the plurality of frame components by inserting the insert part of an attachment component into the groove of one of the four sides of the frame body of a frame component.

11. The modular seating system of claim 10, wherein the plurality of frame components comprises seating frames configured to seat a user.

12. The modular seating system of claim 10, wherein the plurality of attachment components comprises a chair seat back, and wherein the at least one friction plate of the chair seat back is configured to allow the chair seat back to tilt to a predetermined angle within the groove when a force is applied to the chair seat back.

13. The modular seating system of claim 10, wherein the plurality of attachment components comprises a rectangular table having a plurality of legs, wherein each one of the plurality of legs is configured to fold along an underside of the rectangular table such that the rectangular table is usable with four legs, two legs, or no legs when associated with a frame component of the plurality of frame components.

14. The modular seating system of claim 10, wherein the plurality of attachment components comprises a supplemental insert piece having a first groove insert configured to fit into a first groove of a first frame component, and a second groove insert configured to fit into a second groove of a second frame component, such that the first frame component and the second frame component are attached together.

15. The modular seating system of claim 10, wherein the plurality of attachment components comprises a supplemental insert piece having a first groove insert configured to fit into a first groove of a first frame component, and a second groove insert configured to fit into a second groove of a second frame component, such that the first frame component and the second frame component are attached together.

16. The modular seating system of claim 10, wherein the groove is constructed from metal.

17. A method of providing a customizable seating configuration, comprising:

providing a plurality of frame components, each frame component comprising:
- a frame body having legs;
- a top end having four sides and four corners;
- a groove along each one of the four sides;
- a corner block at each one of the four corners;
- wherein the groove is constructed from metal;

providing a plurality of attachment components, each attachment component comprising:
- an attachment body;
- an insert part configured to fit into a groove of the plurality of frame components, the insert part having a first side and a second side; and
- at least one friction plate associated with the insert part;
- wherein the at least one friction plate wraps around the insert part such that the at least one friction plate surrounds a portion of the first side and a portion of the second side of the insert part;

wherein each attachment component of the plurality of attachment components is configured to associate with any one of the frame components of the plurality of frame components by inserting the insert part of an attachment component into the groove of one of the four sides of the frame body of a frame component; and providing a plurality of cushioning materials for the customizable seating configuration.

18. The method of claim 17, wherein the plurality of cushioning materials is water resistant.

19. The method of claim 17, wherein the plurality of attachment components comprises a supplemental insert piece having a first groove insert configured to fit into a first groove of a first frame component, and a second groove insert configured to fit into a second groove of a second frame component, such that the first frame component and the second frame component are attached together.

20. The method of claim 17, wherein the plurality of attachment components comprises a rectangular table having a plurality of legs, wherein each one of the plurality of legs is configured to fold along an underside of the rectangular table such that the rectangular table is usable with four legs, two legs, or no legs when associated with a frame component of the plurality of frame components.

* * * * *